US012566006B2

(12) United States Patent
Mohammad et al.

(10) Patent No.: US 12,566,006 B2
(45) Date of Patent: Mar. 3, 2026

(54) SYSTEM AND METHOD FOR REFRIGERANT LEAK DETECTION

(71) Applicant: Tyco Fire & Security GmbH, Neuhausen am Rheinfall (CH)

(72) Inventors: Mujibul Rehaman Mohammad, Kakinada (IN); Ewin Ramster Melwin, Navi Mumbai (IN); Karan Garg, Jagadhr (IN); Norman Jack Blanton, Norman, OK (US); Anand Mallinath Dulange, Solapur (IN)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 192 days.

(21) Appl. No.: 18/227,093

(22) Filed: Jul. 27, 2023

(65) Prior Publication Data

US 2024/0035695 A1 Feb. 1, 2024

(30) Foreign Application Priority Data

Jul. 29, 2022 (IN) ..... 202221043515

(51) Int. Cl.

| | |
|---|---|
| ***F24F 11/36*** | (2018.01) |
| ***F24F 11/63*** | (2018.01) |
| ***F24F 11/88*** | (2018.01) |
| ***F24F 11/89*** | (2018.01) |

(52) U.S. Cl.

CPC ..... *F24F 11/36* (2018.01); *F24F 11/63* (2018.01); *F24F 11/88* (2018.01); *F24F 11/89* (2018.01)

(58) Field of Classification Search

CPC .. F24F 11/36; F24F 11/63; F24F 11/88; F24F 11/89; F24F 2110/10; F24F 2110/40; F24F 2140/12; F24F 2140/20; G05B 13/0265; G05B 15/02

See application file for complete search history.

(56) References Cited

U.S. PATENT DOCUMENTS

| | | | | |
|---|---|---|---|---|
| 10,928,084 | B2 * | 2/2021 | Ajax | G05B 19/042 |
| 2019/0170603 | A1 * | 6/2019 | Gupte | F25B 49/005 |
| 2020/0300495 | A1 | 9/2020 | Kingetsu | |
| 2021/0071889 | A1 * | 3/2021 | Picardi | F24F 11/49 |
| 2021/0191826 | A1 | 6/2021 | Duraisingh et al. | |

(Continued)

OTHER PUBLICATIONS

U.S. Appl. No. 18/895,144, filed Sep. 24, 2024, O'Dierno et al.

(Continued)

*Primary Examiner* — Francis C Gray

(74) *Attorney, Agent, or Firm* — Foley & Lardner LLP

(57) ABSTRACT

A system for refrigerant leak detection includes one or more sensors configured to detect one or more parameters of a heating, ventilation, and/or air conditioning (HVAC) system. The system further includes one or more storage devices storing instructions thereon that, when executed by one or more processors, cause the one or more processors to receive sensor data from the one or more sensors; apply the sensor data to one or more machine learning models, the one or more machine learning models trained to identify refrigerant leaks associated with HVAC systems; determine, using the one or more machine learning models, that the sensor data is indicative of a refrigerant leak; and, in response to determining that the sensor data is indicative of the refrigerant leak, initiate a response action.

20 Claims, 8 Drawing Sheets

(56) References Cited

U.S. PATENT DOCUMENTS

| | | | | |
|---|---|---|---|---|
| 2021/0278102 | A1* | 9/2021 | Sabat | F24F 11/77 |
| 2022/0268479 | A1 | 8/2022 | Jang et al. | |
| 2022/0268503 | A1 | 8/2022 | Yoshimi et al. | |
| 2022/0390913 | A1 | 12/2022 | Pelski et al. | |
| 2023/0116964 | A1 | 4/2023 | Sun et al. | |
| 2023/0169220 | A1 | 6/2023 | Ramanasankaran et al. | |
| 2023/0194137 | A1 | 6/2023 | Fan et al. | |
| 2024/0035695 | A1 | 2/2024 | Mohammad et al. | |
| 2024/0068721 | A1 | 2/2024 | Feng et al. | |

OTHER PUBLICATIONS

Feng et al., "A Semi-Supervised Data-Driven Approach for Chiller Refrigerant Leakage Detection," 3rd IIR Conference on HFO Refrigerants and Low GWP Blends, Shanghai, China, 2023 (8 pages).

Trinh et al., "Detecting Mobile Traffic Anomalies Through Physical Control Channel Fingerprinting: A Deep Semi-Supervised Approach," IEEE Access, Oct. 2019, vol. 7 (pp. 152187-152201).

* cited by examiner

SYSTEM AND METHOD FOR REFRIGERANT LEAK DETECTION

CROSS-REFERENCE TO RELATED PATENT APPLICATION

This application claims the benefit of and priority to Indian Provisional Patent Application No. 202221043515, filed Jul. 29, 2022, which is incorporated herein by reference in its entirety.

BACKGROUND

The present disclosure relates generally to heating, ventilation, and/or conditioning (HVAC) systems for a building.

An HVAC system is used to provide proper ventilation and maintain air quality in a confined space, for example, a commercial or household building. The HVAC system typically includes a refrigerant circuit having a compressor, a condenser, an expansion device, and an evaporator. Refrigerant is compressed in the compressor, which raises the temperature of the refrigerant. After passing through the compressor, the high pressure and high temperature refrigerant passes through the condenser, where the refrigerant rejects heat to a cooling medium. The refrigerant then passes through the expansion device, which expands the refrigerant and lowers its temperature. The refrigerant then enters the evaporator, where the refrigerant absorbs heat before reentering the compressor, thereby completing the refrigerant's cycle.

The refrigerant circuit includes various pipes or conduits connected between the compressor, the condenser, the expansion device, and the evaporator to facilitate refrigerant flow therebetween. The pipes or conduits may be susceptible to leakage. Refrigerant, if leaked, can mix with supply air and may enter a space served by the HVAC system. In some instances, refrigerants may be flammable. In these instances, it is possible for leaked refrigerant to catch fire and cause damage to components of HVAC system. Additionally, in some instances, refrigerants may be toxic in nature. Thus, leaked refrigerant interacting with occupants can potentially cause various health hazards.

SUMMARY

One implementation of the present disclosure is a system for refrigerant leak detection. The system comprises one or more sensors configured to detect one or more parameters of a heating, ventilation, and/or air conditioning (HVAC) system. The system further comprises one or more storage devices storing instructions thereon that, when executed by one or more processors, cause the one or more processors to receive sensor data from the one or more sensors. The instructions further cause the one or more processors to apply the sensor data to one or more machine learning models, the one or more machine learning models trained to identify refrigerant leaks associated with HVAC systems. The instructions further cause the one or more processors to determine, using the one or more machine learning models, that the sensor data is indicative of a refrigerant leak. The instructions further cause the one or more processors to in response to determining that the sensor data is indicative of the refrigerant leak, initiate a response action.

Another implementation of the present disclosure is a system for refrigerant leak detection. The system comprises one or more storage devices storing instructions thereon that, when executed by one or more processors, cause the one or more processors to collect test data corresponding to one or more refrigerant leaks associated with heating, ventilation, and/or air conditioning (HVAC) systems. The instructions further cause the one or more processors to train one or more machine learning models to identify refrigerant leaks associated with HVAC systems using the test data. The instructions further cause the one or more processors to receive sensor data from one or more sensors associated with an HVAC system. The instructions further cause the one or more processors to determine, using the one or more machine learning models, that the sensor data is indicative of a refrigerant leak.

Another implementation of the present disclosure is a method for refrigerant leak detection. The method comprises receiving, by one or more processors of a system, sensor data from one or more sensors associated with a heating, ventilation, and/or air conditioning (HVAC) system. The method further comprises applying, by the one or more processors, the sensor data to one or more machine learning models, the one or more machine learning models trained to identify refrigerant leaks associated with HVAC systems. The method further comprises determining, by the one or more processors using the one or more machine learning models, that the sensor data is indicative of a refrigerant leak. The method further comprises, in response to determining that the sensor data is indicative of the refrigerant leak, initiating, by the one or more processors, a response action.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Building HVAC System

Figure 1:
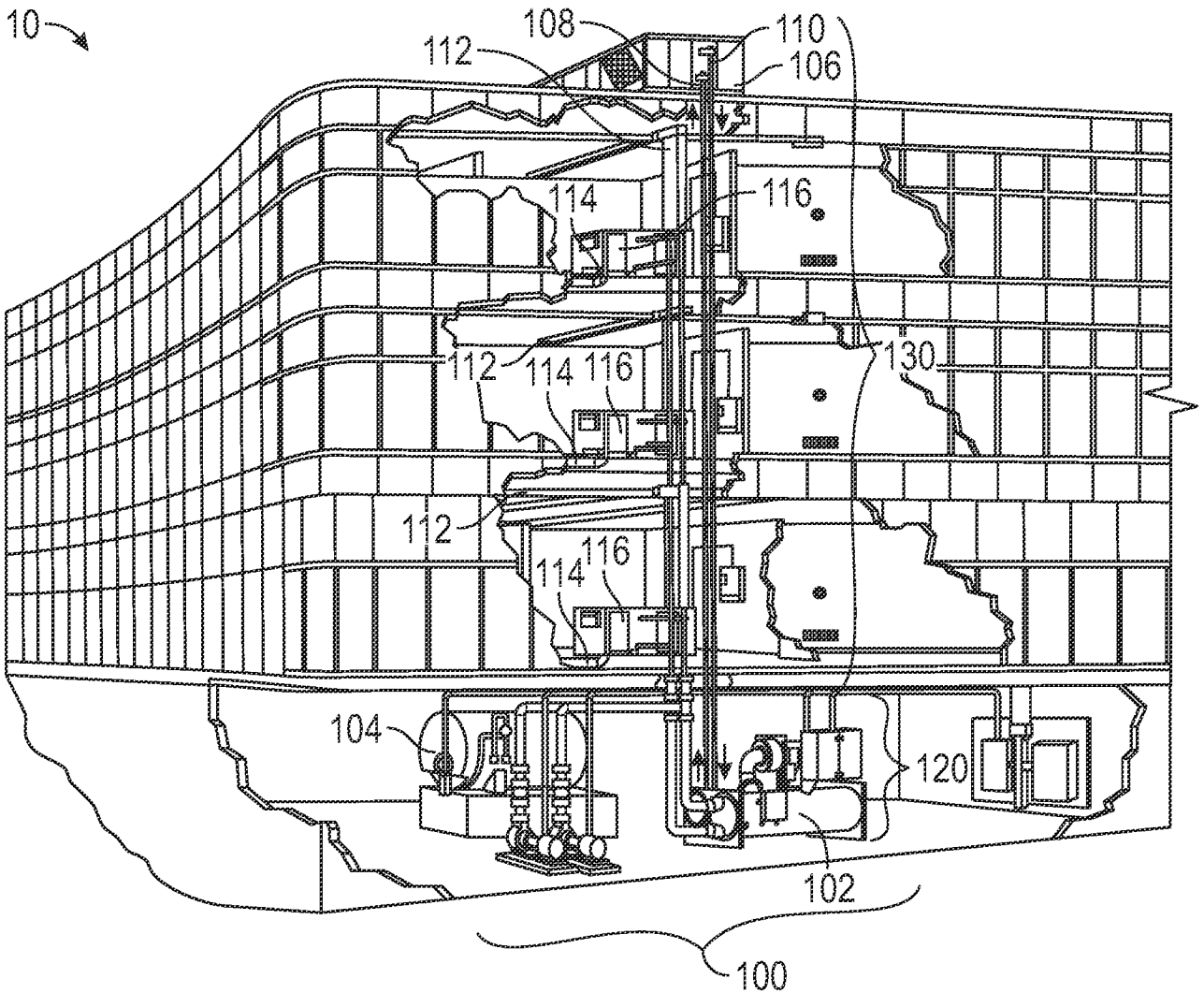
FIG. 1 is a perspective view of a building including a heating, ventilating, or air conditioning (HVAC) system, according to an exemplary embodiment.

Referring now to FIG. 1, a perspective view of a building 10 is shown. Building 10 is served by a heating, ventilating, or air conditioning (HVAC) system 100. HVAC system 100 can include a plurality of HVAC devices (e.g., heaters, chillers, air handling units, pumps, fans, thermal energy storage, etc.) configured to provide heating, cooling, air conditioning, ventilation, and/or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.) that serves one or more buildings including building 10. The working fluid can be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 may place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 may transfer heat between the airflow and the working fluid to provide heating or cooling for the airflow. For example, AHU 106 can include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Airside System

Figure 2:
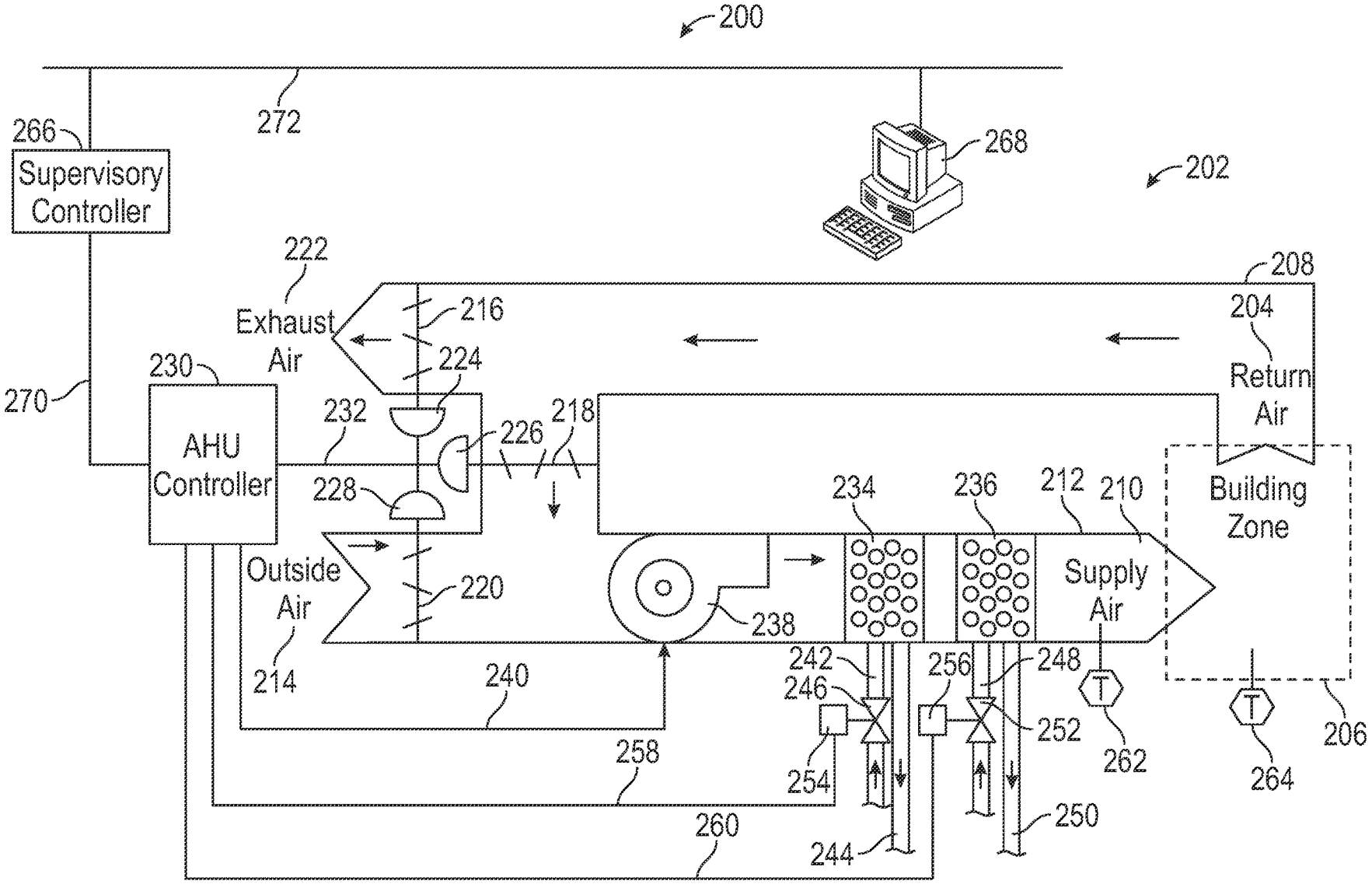
FIG. 2 is a block diagram of an airside system including an air handling unit (AHU) which can be used in the HVAC system of FIG. 1, according to an exemplary embodiment.

Referring now to FIG. 2, a block diagram of an airside system 200 is shown, according to some embodiments. In various embodiments, airside system 200 may supplement or replace airside system 130 in HVAC system 100 or can be implemented separate from HVAC system 100. When implemented in HVAC system 100, airside system 200 can include a subset of the HVAC devices in HVAC system 100 (e.g., AHU 106, VAV units 116, ducts 112-114, fans, dampers, etc.) and can be located in or around building 10. Airside system 200 may operate to heat or cool an airflow provided to building 10 using a heated or chilled fluid provided by waterside system 120.

In FIG. 2, airside system 200 is shown to include an economizer-type air handling unit (AHU) 202. Economizer-type AHUs vary the amount of outside air and return air used by the air handling unit for heating or cooling. For example, AHU 202 may receive return air 204 from building zone 206 via return air duct 208 and may deliver supply air 210 to building zone 206 via supply air duct 212. In some embodiments, AHU 202 is a rooftop unit located on the roof of building 10 (e.g., AHU 106 as shown in FIG. 1) or otherwise positioned to receive both return air 204 and outside air 214. AHU 202 can be configured to operate exhaust air damper 216, mixing damper 218, and outside air damper 220 to control an amount of outside air 214 and return air 204 that combine to form supply air 210. Any return air 204 that does not pass-through mixing damper 218 can be exhausted from AHU 202 through exhaust damper 216 as exhaust air 222.

Each of dampers 216-220 can be operated by an actuator. For example, exhaust air damper 216 can be operated by actuator 224, mixing damper 218 can be operated by actuator 226, and outside air damper 220 can be operated by actuator 228. Actuators 224-228 may communicate with an AHU controller 230 via a communications link 232. Actuators 224-228 may receive control signals from AHU controller 230 and may provide feedback signals to AHU controller 230. Feedback signals can include, for example, an indication of a current actuator or damper position, an amount of torque or force exerted by the actuator, diagnostic information (e.g., results of diagnostic tests performed by actuators 224-228), status information, commissioning information, configuration settings, calibration data, and/or other types of information or data that can be collected, stored, or used by actuators 224-228. AHU controller 230 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 224-228.

Still referring to FIG. 2, AHU 202 is shown to include a cooling coil 234, a heating coil 236, and a fan 238 positioned within supply air duct 212. Fan 238 can be configured to force supply air 210 through cooling coil 234 and/or heating coil 236 and provide supply air 210 to building zone 206. AHU controller 230 may communicate with fan 238 via communications link 240 to control a flow rate of supply air 210. In some embodiments, AHU controller 230 controls an amount of heating or cooling applied to supply air 210 by modulating a speed of fan 238.

Cooling coil 234 may receive a chilled fluid from waterside system 120 (via piping 242 and may return the chilled fluid to waterside system 120 via piping 244. Valve 246 can be positioned along piping 242 or piping 244 to control a flow rate of the chilled fluid through cooling coil 234. In some embodiments, cooling coil 234 includes multiple stages of cooling coils that can be independently activated and deactivated (e.g., by AHU controller 230, by supervisory controller 266, etc.) to modulate an amount of cooling applied to supply air 210.

Heating coil 236 may receive a heated fluid from waterside system 120 via piping 248 and may return the heated fluid to waterside system 120 via piping 250. Valve 252 can be positioned along piping 248 or piping 250 to control a flow rate of the heated fluid through heating coil 236. In some embodiments, heating coil 236 includes multiple stages of heating coils that can be independently activated and deactivated (e.g., by AHU controller 230, by supervisory controller 266, etc.) to modulate an amount of heating applied to supply air 210.

Each of valves 246 and 252 can be controlled by an actuator. For example, valve 246 can be controlled by actuator 254 and valve 252 can be controlled by actuator 256. Actuators 254-256 may communicate with AHU controller 230 via communications links 258-260. Actuators 254-256 may receive control signals from AHU controller 230 and may provide feedback signals to controller 230. In some embodiments, AHU controller 230 receives a measurement of the supply air temperature from a temperature sensor 262 positioned in supply air duct 212 (e.g., downstream of cooling coil 234 and/or heating coil 236). AHU controller 230 may also receive a measurement of the temperature of building zone 206 from a temperature sensor 264 located in building zone 206.

In some embodiments, AHU controller 230 operates valves 246 and 252 via actuators 254-256 to modulate an amount of heating or cooling provided to supply air 210 (e.g., to achieve a setpoint temperature for supply air 210 or to maintain the temperature of supply air 210 within a setpoint temperature range). The positions of valves 246 and 252 affect the amount of heating or cooling provided to supply air 210 by cooling coil 234 or heating coil 236 and may correlate with the amount of energy consumed to achieve a desired supply air temperature. AHU controller 230 may control the temperature of supply air 210 and/or building zone 206 by activating or deactivating coils 234-236, adjusting a speed of fan 238, or a combination of both.

Still referring to FIG. 2, airside system 200 is shown to include a supervisory controller 266 and a client device 268. Supervisory controller 266 can include one or more computer systems (e.g., servers, supervisory controllers, subsystem controllers, etc.) that serve as system level controllers, application or data servers, head nodes, or master controllers for airside system 200, waterside system 120, HVAC system 100, and/or other controllable systems that serve building 10. Supervisory controller 266 may communicate with multiple downstream building systems or subsystems (e.g., HVAC system 100, a security system, a lighting system, waterside system 120, etc.) via a communications link 270 according to like or disparate protocols (e.g., LON, BACnet, etc.). In various embodiments, AHU controller 230 and supervisory controller 266 can be separate (as shown in FIG. 2) or integrated. In an integrated implementation, AHU controller 230 can be a software module configured for execution by a processor of supervisory controller 266.

In some embodiments, AHU controller 230 receives information from supervisory controller 266 (e.g., commands, setpoints, operating boundaries, etc.) and provides information to supervisory controller 266 (e.g., temperature measurements, valve or actuator positions, operating statuses, diagnostics, etc.). For example, AHU controller 230 may provide supervisory controller 266 with temperature measurements from temperature sensors 262-264, equipment on/off states, equipment operating capacities, and/or any other information that can be used by supervisory controller 266 to monitor or control a variable state or condition within building zone 206.

Client device 268 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 268 can be a computer workstation, a client terminal, a remote or local interface, or any other type of user interface device. Client device 268 can be a stationary terminal or a mobile device. For example, client device 268 can be a desktop computer, a computer server with a user interface, a laptop computer, a tablet, a smartphone, a PDA, or any other type of mobile or non-mobile device. Client device 268 may communicate with supervisory controller 266 and/or AHU controller 230 via communications link 272.

AHU Controller

Figure 3:
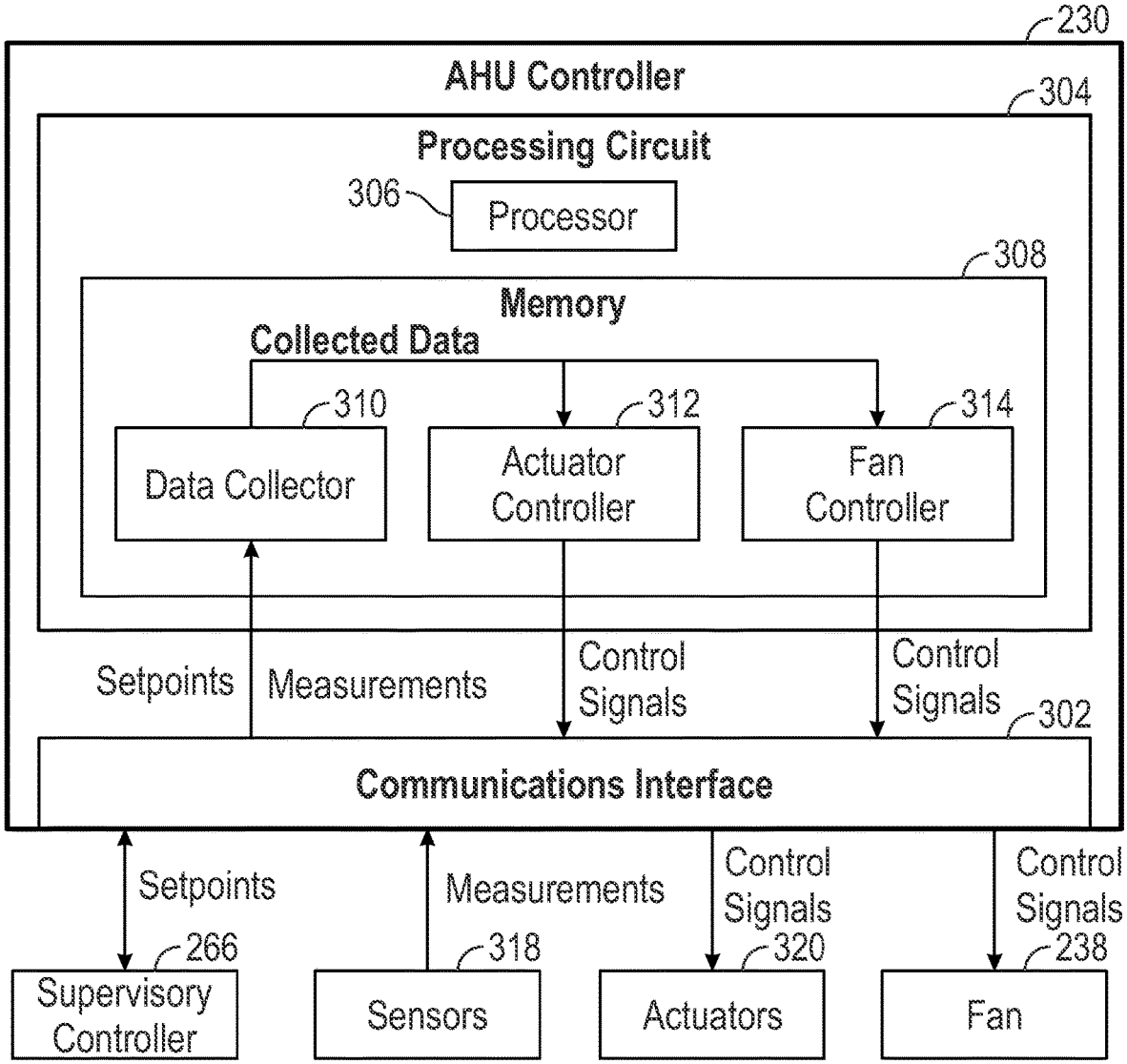
FIG. 3 is a block diagram of an AHU controller which can be used to monitor and control the AHU of FIG. 2, according to an exemplary embodiment.

Referring now to FIG. 3, a block diagram illustrating AHU controller 230 in greater detail is shown, according to an example embodiment. AHU controller 230 may be configured to monitor and control various components of AHU 202 using any of a variety of control techniques (e.g., state-based control, on/off control, proportional control, proportional-integral (PI) control, proportional-integral-derivative (PID) control, extremum seeking control (ESC), model predictive control (MPC), etc.). AHU controller 230 may receive setpoints from supervisory controller 266 and measurements from sensors 318 and may provide control signals to actuators 320 and fan 238.

Sensors 318 may include any of the sensors shown in FIG. 2 or any other sensor configured to monitor any of a variety of variables used by AHU controller 230. Variables monitored by sensors 318 may include, for example, zone air temperature, zone air humidity, zone occupancy, zone CO2 levels, zone particulate matter (PM) levels, outdoor air temperature, outdoor air humidity, outdoor air CO2 levels, outdoor air PM levels, damper positions, valve positions, fan status, supply air temperature, supply air flowrate, or any other variable of interest to AHU controller 230.

Actuators 320 may include any of the actuators shown in FIG. 2 or any other actuator controllable by AHU controller 230. For example, actuators 320 may include actuator 224 configured to operate exhaust air damper 216, actuator 226 configured to operate mixing damper 218, actuator 228 configured to outside air damper 220, actuator 254 configured to operate valve 246, and actuator 256 configured to operate valve 252. Actuators 320 may receive control signals from AHU controller 230 and may provide feedback signals to AHU controller 230.

AHU controller 230 may control AHU 202 by controllably changing and outputting a control signal provided to actuators 320 and fan 238. In some embodiments, the control signals include commands for actuators 320 to set dampers 216-220 and/or valves 246 and 252 to specific positions to achieve a target value for a variable of interest (e.g., supply air temperature, supply air humidity, flow rate, etc.). In some embodiments, the control signals include commands for fan 238 to operate a specific operating speed or to achieve a specific airflow rate. The control signals may be provided to actuators 320 and fan 238 via communications interface 302. AHU 202 may use the control signals an input to adjust the positions of dampers 216-220 control the relative proportions of outside air 214 and return air 204 provided to building zone 206.

AHU controller 230 may receive various inputs via communications interface 302. Inputs received by AHU controller 230 may include setpoints from supervisory controller 266, measurements from sensors 318, a measured or observed position of dampers 216-220 or valves 246 and 252, a measured or calculated amount of power consumption, an observed fan speed, temperature, humidity, air quality, or any other variable that can be measured or calculated in or around building 10.

AHU controller 230 includes logic that adjusts the control signals to achieve a target outcome. In some operating modes, the control logic implemented by AHU controller 230 utilizes feedback of an output variable. The logic implemented by AHU controller 230 may also or alternatively vary a manipulated variable based on a received input signal (e.g., a setpoint). Such a setpoint may be received from a user control (e.g., a thermostat), a supervisory controller (e.g., supervisory controller 266), or another upstream device via a communications network (e.g., a BACnet network, a LonWorks network, a LAN, a WAN, the Internet, a cellular network, etc.).

Still referring to FIG. 3, AHU controller 230 is shown to include a communications interface 302. Communications interface 302 can be or include wired or wireless communications interfaces (e.g., jacks, antennas, transmitters, receivers, transceivers, wire terminals, etc.) for conducting data communications with various components of AHU 202 or other external systems or devices. In various embodiments, communications via communications interface 302 can be direct (e.g., local wired or wireless communications) or via a communications network (e.g., a WAN, the Internet, a cellular network, etc.). For example, communications interface 302 can include an Ethernet card and port for sending and receiving data via an Ethernet-based communications link or network. In another example, communications interface 302 can include a Wi-Fi transceiver for communicating via a wireless communications network. In another example, communications interface 302 can include a cellular or mobile phone transceiver, a power line communications interface, an Ethernet interface, or any other type of communications interface.

Still referring to FIG. 3, AHU controller 230 is shown to include a processing circuit 304 having a processor 306 and memory 308. Processor 306 may be a general purpose or specific purpose processor, an application specific integrated circuit (ASIC), one or more field programmable gate arrays (FPGAs), a group of processing components, or other suitable processing components. Processor 306 is configured to execute computer code or instructions stored in memory 308 or received from other computer readable media (e.g., CDROM, network storage, a remote server, etc.).

Memory 308 may include one or more devices (e.g., memory units, memory devices, storage devices, etc.) for storing data and/or computer code for completing and/or facilitating the various processes described in the present disclosure. Memory 308 may include random access memory (RAM), read-only memory (ROM), hard drive storage, temporary storage, non-volatile memory, flash memory, optical memory, or any other suitable memory for storing software objects and/or computer instructions. Memory 308 may include database components, object code components, script components, or any other type of information structure for supporting the various activities and information structures described in the present disclosure. Memory 308 may be communicably connected to processor 306 via processing circuit 304 and may include computer code for executing (e.g., by processor 306) one or more processes described herein.

Memory 308 can include any of a variety of functional components (e.g., stored instructions or programs) that provide AHU controller 230 with the ability to monitor and control AHU 202. For example, memory 308 is shown to include a data collector 310 which operates to collect the data received via communications interface 302 (e.g., setpoints, measurements, feedback from actuators 320 and fan 238, etc.). Data collector 310 may provide the collected data to actuator controller 312 and fan controller 314 which use the collected data to generate control signals for actuators 320 and fan 238, respectively. The particular type of control methodology used by actuator controller 312 and fan controller 314 (e.g., state-based control, PI control, PID control, ESC, MPC, etc.) may vary depending on the configuration of AHU controller and can be adapted for various implementations.

Refrigerant Loop

Figure 4:
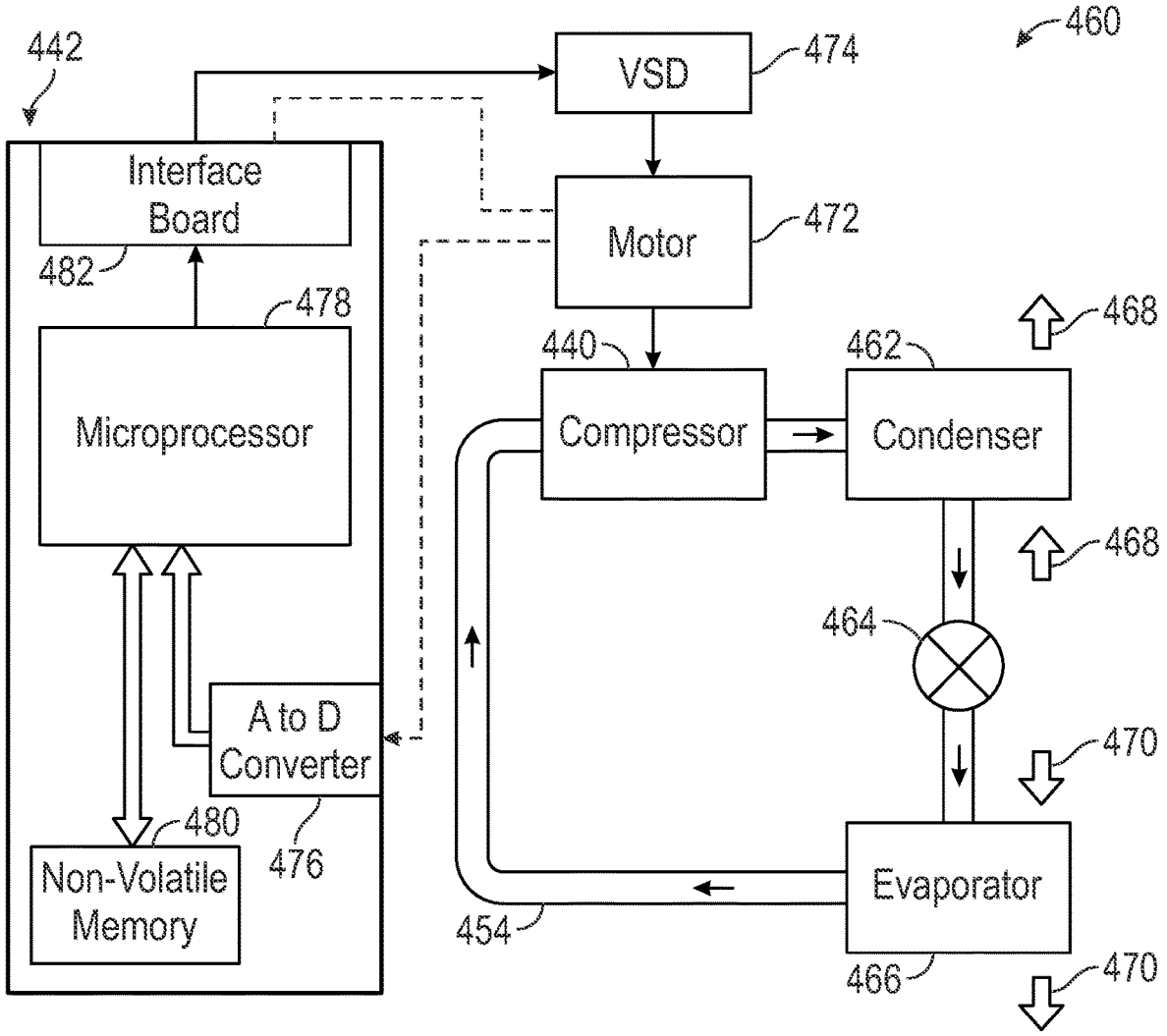
FIG. 4 is a block diagram of a refrigerant loop that may be implemented in an HVAC system, according to an exemplary embodiment.

Referring to FIG. 4, an example schematic of a portion 460 of an HVAC unit is shown. The HVAC unit can be a split air conditioning unit, a packaged air conditioning unit, or any other suitable air conditioning unit. As depicted, the HVAC unit includes a compressor 440, a condenser 462, one or more expansion devices 464 or valves, and an evaporator 466. As described above, the condenser 462 and/or the evaporator 466 may each be implemented using one or more heat exchangers. In any case, actuation of the compressor 440 generally drives circulation of refrigerant through the refrigerant conduits 454. In particular, the compressor 440 may receive refrigerant vapor from the evaporator 466, compress the refrigerant vapor, and output the compressed refrigerant vapor to the condenser 462.

As the refrigerant flows through the condenser 462, a first air flow 468 may be used to extract heat from refrigerant to facilitate condensing the vapor into liquid. When operating in a cooling mode, the first air flow 468 may be produced using environmental or outside air, for example, by actuating a fan. On the other hand, when operating in a heating mode, the first air flow 468 may be produced using supply air, for example, by actuating a blower assembly. Before being supplied to the evaporator 466, the refrigerant may flow through one or more expansion devices 464 to facilitate reducing pressure.

As the refrigerant flows through the evaporator 466, the refrigerant may undergo a phase change from liquid to vapor that facilitates extracting heat from a second air flow 470. When operating in a cooling mode, the second air flow 470 may be produced using supply air, for example, by actuating a blower assembly. On the other hand, when operating in a heating mode, the second air flow 470 may be produced using environmental or outside air, for example, by actuating a fan. Thereafter, the refrigerant may be circulated back to the compressor 440.

As depicted, the compressor 440 may be actuated by a motor 472 during operation. In some embodiments, the motor 472 may be a switched reluctance motor, an induction motor, an electronically commutated permanent magnet motor, and/or another suitable electromechanical motor. In other words, the motor 472 may actuate the compressor 440 when electrical power is supplied to the motor 472.

To facilitate controlling supply of electrical power to the motor 472, a variable speed drive (VSD) 474 and/or a control board 442 may be coupled to the motor 472. In particular, the variable speed drive 474 may receive alternating current (AC) electrical power having a fixed line voltage and a fixed line frequency from a power source, such as an electrical grid. Additionally, the control board 442 may control operation of the variable speed drive 474 to supply alternating current (AC) electrical power with a variable voltage and/or a variable frequency to the motor 472, for example, by controlling switching devices implemented in the variable speed drive 474. In other embodiments, the motor 472 may be powered directly from an AC power source or a direct current (DC) power source, such as a battery.

To facilitate controlling operation of the variable speed drive 474 or motor 472, as in the depicted embodiment, the control board 442 may include an analog to digital (A/D) converter 476, a microprocessor 478, non-volatile memory 480, and an interface 482. For example, to control switching in the variable speed drive 474, the microprocessor 478 may execute instructions stored in a tangible, non-transitory, computer-readable medium, such as the non-volatile memory 480, to determine control signals or commands, which may be communicated to the variable speed drive 474 via the interface 482. Additionally, the control board 442 may control switching in the variable speed drive 474 based at least in part on feedback from the motor 472 and/or other sensors, for example, as analog electrical signals, which may be converted to digital data via the analog to digital (A/D) converter 476 before processing by the microprocessor 478.

Refrigerant Leak Detection

Referring to FIG. 4, refrigerant typically passes through the compressor 440, the condenser 462, the expansion valve 464, the evaporator 466, and back to the compressor 440. Conduits 454 are provided to facilitate refrigerant flow through aforementioned components. In some instances, the conduits 454 include various joints, which may be susceptible to leakage. Further, in some instances, refrigerant may leak through the compressor 440, the condenser 462, the expansion valve 464, and/or the evaporator 466.

Refrigerant leakage can cause result in a variety of negative effects. In some instances, refrigerant leakage can cause damage to components of an HVAC system. For example, because refrigerant is often flammable in nature, leaked refrigerant may catch fire, thereby causing severe damage to the components of the HVAC system. As such, fire suppression systems are generally needed to mitigate the risk of fire damage due to potential refrigerant leakages. Leaked refrigerant can also mix with supply air and ultimately reach occupants of a space serviced by the HVAC system, which may cause various health issues (e.g., breathing difficulty, headache, nose and eye irritation, nausea, vomiting). Further, many refrigerants have high Ozone Depletion Potential (ODP) and/or high Global Warming Potential (GWP). Thus, if leakage of refrigerant is not detected immediately, the leaked refrigerant can negatively impact the environment. Additionally, due to refrigerant leakage, a total amount of refrigerant flowing through the refrigerant circuit gradually reduces, thereby resulting in a lowered efficiency and potentially inadequate temperature control provided by the HVAC system.

The present disclosure discloses a method and system for refrigerant leak detection that alleviates the aforementioned drawbacks of conventional approaches.

Figure 5:
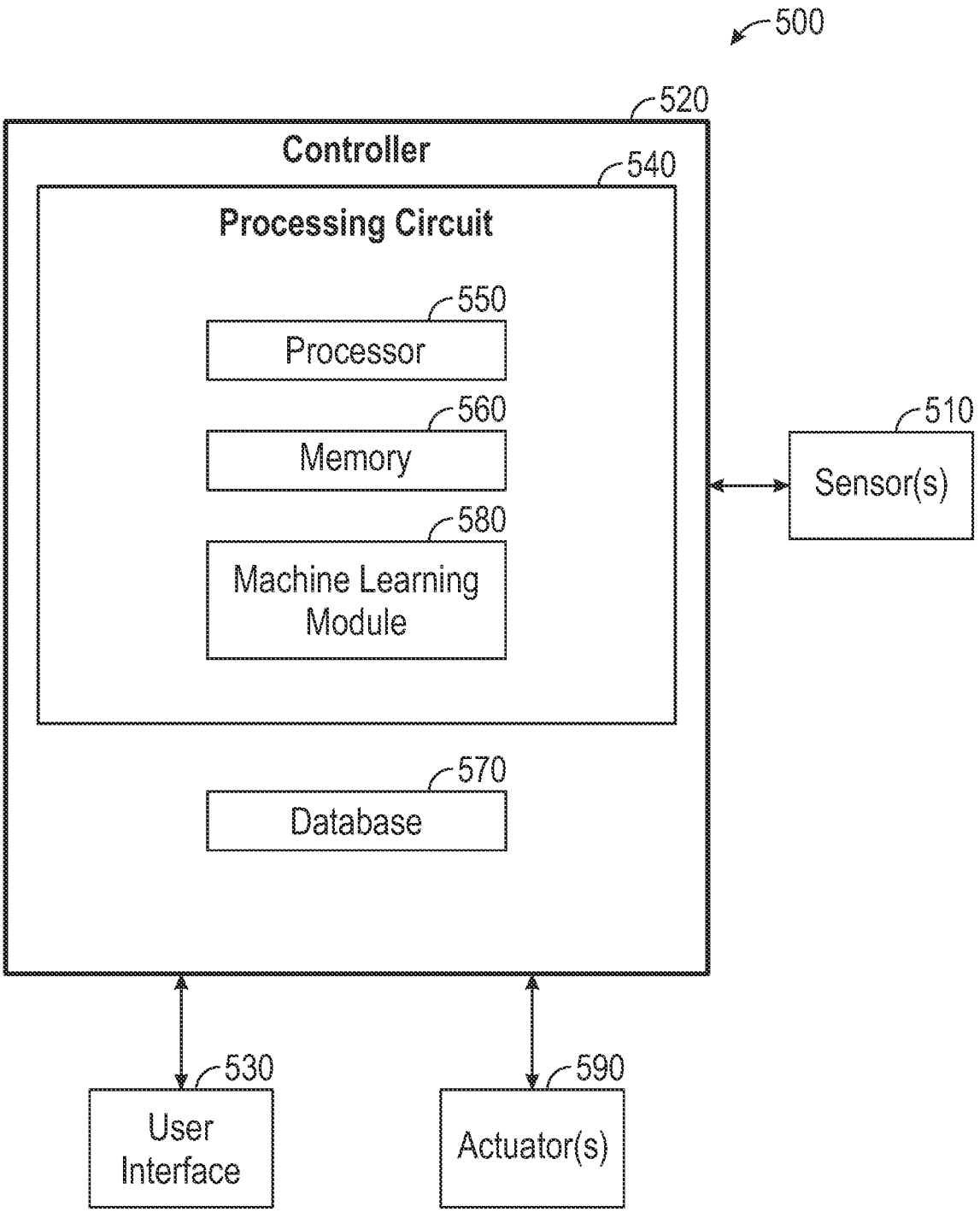
FIG. 5 is a block diagram of a system for refrigerant leak detection, according to an exemplary embodiment.

Referring to FIG. 5, a system 500 for detecting refrigerant leakage in an HVAC system (e.g., HVAC system 100) is shown, according to an example embodiment. The system 500 includes one or more sensors 510 provided to sense various parameters related to the HVAC system. The one or more sensors 510 can include temperature and/or pressure sensors provided to sense temperature and/or pressure of refrigerant flowing through a refrigerant circuit of an HVAC system and air flowing through the HVAC system. For example, the sensors 510 can measure temperature and/or pressure of at least one of supply air and/or return air. In some embodiments, the sensors 510 further include one or more refrigerant/gas detecting sensors for detecting leaked refrigerant (e.g., configured to detect the presence of leaked refrigerant/gas in areas or spaces) outside of the intended refrigerant circuit).

In some embodiments, the sensors 510 can be located within the HVAC system to measure aforementioned parameters. For example, a temperature sensor can be provided within the HVAC system to measure temperature of refrigerant in an evaporator coil (e.g., within the evaporator 466) of the HVAC system. Another temperature sensor can be located in a return air duct to measure temperature of return air. A temperature sensor can also be located in a supply air duct to measure temperature of supply air. Similarly, pressure sensors can also be placed in supply air duct and return air duct to measure pressure of supply air and return air, respectively. One or more sensors can also be provided in conduits carrying refrigerant from one component to another of the HVAC system. For example, with reference to FIG. 4, one or more sensors may be placed in the compressor 440, the condenser 462, the expansion valve 464, the evaporator 466, and/or conduits 454 to transmit signals indicative of sensed temperature and/or pressure data related to refrigerant.

It should be appreciated that the various sensors and sensor locations discussed above are provided as examples and are in no way meant to be limiting. In other examples, additional or fewer sensors of the same or differing types may be includes in the same or other arrangements, and these variations are within the scope of the present disclosure.

Still referring to FIG. 5, the system 500 includes a controller 520 in communication with the sensors 510. The controller 520 may be a controller of an HVAC system (e.g., HVAC system 100) for which the system 500 is to be deployed. In other embodiments, the controller 520 may be independently provided to detect refrigerant leakage.

The controller 520 receives sensed data in form of signals indicative of parameters of refrigerant, supply air, and/or return air. The sensor(s) 510 may periodically establish communication with the controller 520 as per system defined rules that can be once every few seconds, once in few minutes, or once in few hours to transmit sensed data. The communication between the sensor 510 and the controller 520 can be either wired or wireless. In some instances, the sensor 510 may communicate with the controller 520 at multiple times which may be separated by a pre-determined time difference to improve accuracy. The pre-determined time difference may be a user-defined time difference provided via a user interface 530 in communication with the controller 520.

In some embodiments, the user interface 530 can include a desktop computer, a laptop computer, a tablet, a smartphone, a personal digital assistance (PDA), or any other type of mobile or non-mobile device. The controller 520 can periodically send request signals to the sensor 510 requesting sensed data. In some embodiments, the controller 520 may include a signal conditioner that is configured to convert or transform the value received from the sensor 510. For example, the signal conditioner may include one or more analogue to digital converters (e.g., similar to the A/D converter 476) to convert analogue sensed data or signals received from the sensor 510 into digital values.

The controller 520 includes a processing circuit 540 having a processor 550 and a memory 560. Processor 550 can be implemented as a general-purpose processor, an application specific integrated circuit (ASIC), one or more field programmable gate arrays (FPGAs), a group of processing components, or other suitable electronic processing components.

Memory 560 (e.g., memory, memory unit, storage device, etc.) can include one or more devices (e.g., RAM, ROM, Flash memory, hard disk storage, etc.) for storing data and/or computer code for completing or facilitating the various processes, layers and modules described herein. Memory 560 can be or include volatile memory or non-volatile memory. Memory 560 can include database components, object code components, script components, or any other type of information structure for supporting the various activities and information structures described herein. According to some embodiments, memory 560 is communicably connected to processor 550 via processing circuit 540 and includes computer code for executing (e.g., by processing circuit 540 and/or processor 550) one or more processes described herein.

In some embodiments, the controller 520 includes a database 570. Various parameter values related to refrigerant leak detection may be stored in the database 570. The parameters are typically determined on the basis of type and operating conditions of an HVAC system in which the system 500 is to be employed. In some embodiments, the predetermined parameters stored in the database 570 are editable, and a user can edit the same via the user interface 530.

Although the database 570 is shown to be within the controller 520 in FIG. 5, in some embodiments, the database 570 can be remote from the controller 520. In these instances, the controller 520 may be capable of communicatively coupling to a remote database server having the database 570. The database server may have a processor and memory for performing the database related operations discussed herein. For example, in some embodiments, the database server can include data or information regarding various refrigerant leaks and their characteristic parameter patterns, as well data or information regarding parameter patterns that are not characteristic of refrigerant leaks.

The controller 520 employs a machine learning technique to identify refrigerant leakage in an HVAC system. The database 570 may store information related to sensed data to train the controller 520 for identifying refrigerant leaks. In particular, the database 570 may store a body or corpus of data that is used to train a machine learning module 580, as discussed below. That is, the database 570 may include data entries indicative of sensed parameter patterns associated with particular refrigerant leaks, such as data entries associated with various locations and sizes of leaks and/or leaks associated with particular refrigerant properties, as well as data entries indicative of sensed parameter patterns associated with normal operation of the HVAC system. In some embodiments, the database 570 may include correlations between sensed parameters indicating refrigerant leaks. In some other embodiments, the database 570 may be provided with mathematical expressions and/or rules that can be executed by the machine learning module 580 to identify refrigerant leaks.

In some embodiments, the database 570 may be populated experimentally and subsequently used to train the controller 520 at the time of manufacturing or deploying the system 500. For example, prior to installing the system 500 in an HVAC system (e.g., HVAC system 100) or prior to manufacturing the HVAC system itself, a simulated test setup can be manufactured to collect sensed parameter values and their interrelations that are indicative of and may be used to identify refrigerant leaks. The simulated test setup can be subjected to various test conditions to collect test data that can be used by the controller 520 to train the machine learning module 580. In some embodiments, the test conditions may correspond to different amounts of refrigerant leakage. That is, test conditions may be simulated to obtain sensed parameter data for various refrigerant leak amounts. For example, a first test may be simulated with 100% refrigerant charge; a second test may be simulated with 90% refrigerant charge, wherein 10% charge is considered to be leaked; and so on. Similar tests can be simulated with different refrigerant charge amounts to collect test data corresponding to a variety of parameters, such as temperature and pressure of the refrigerant, the supply air, and/or the return air.

In some embodiments, instead of simulations, such tests may be performed on an actual HVAC system, wherein a technician may intentionally create refrigerant leaks with different amounts and record the test data corresponding to the parameters. In this case, the test data can be obtained using one or more sensors (e.g., similar to the sensors 510) deployed to sense the parameters. The test data is stored in the database 570. In some embodiments, a suitable processor, for example, the processor 550 or any other suitable processor or computing device, may be employed to extrapolate or interpolate the test data to extend the data to cover other sets of parameters that were not experimentally collected.

In some embodiments, collecting the test data, as described above, can be performed once to train the machine learning module 580. In some embodiments, collecting the test data can be performed periodically to continuously train the machine learning module 580. For example, by periodically collecting test data to continuously train the machine learning module 580, changes in parameters of the HVAC system over a long operational run of the system may be efficiently captured. Capturing these changes in parameters can facilitate the machine learning module 580 more accurately predicting refrigerant leakages (e.g., compared to training the machine learning module 580 only once).

Figure 6:
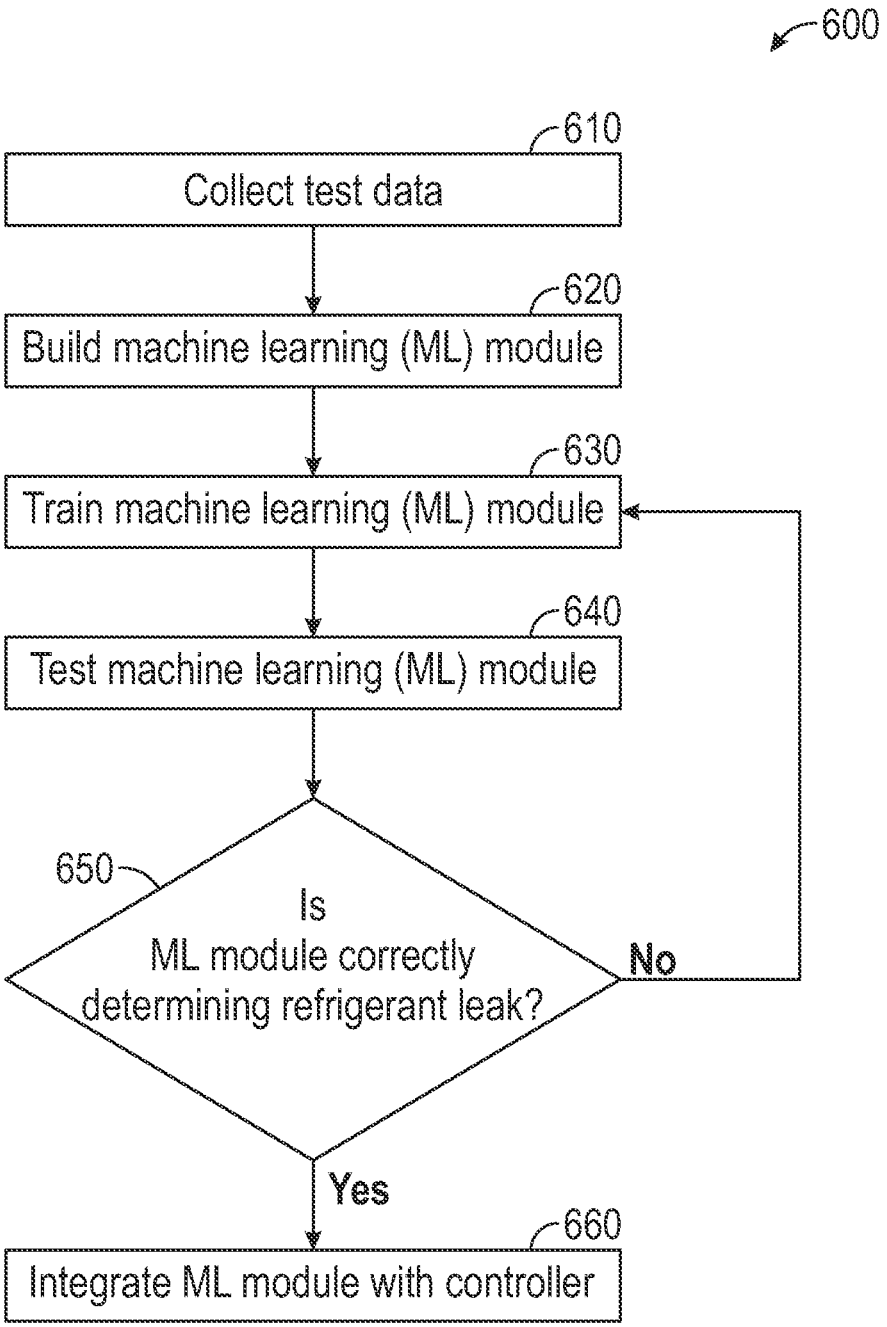
FIG. 6 is a flowchart depicting steps to train a machine learning module of the system of FIG. 5, according to an exemplary embodiment.

Referring now to FIG. 6, a method 600 for training the machine learning module 580 is shown, according to an example embodiment. In some embodiments, the various steps of the method 600 described below may be performed by the controller 520 to control the HVAC system 100. However, it will be appreciated that the method 600 may be implemented into other controllers to control various other HVAC systems or other systems generally, as desired for a given application.

At step 610, test data is collected (e.g., by the processing circuit 540) by running one or more simulations on an HVAC system (e.g., HVAC system 100 or another HVAC system) in which the system 500 is to be employed. The test data can include various parameter values, such as, but not limited to, an evaporation coil temperature value, a return air temperature value, a supply air temperature value, etc. The simulations may include creating various test conditions having variable refrigerant leakage amounts. In some embodiments, as discussed above, the test data can be collected by performing actual tests on an HVAC system.

At step 620, the machine learning module 580 is built. In some embodiments, the machine learning (ML) module 580 can include various correlations between parameters in expected test data. In some embodiments, the parameters in the expected test data include parameters which may be sensed by one or more sensors (e.g., sensors 510). For example, the ML module 580 may include mathematical expressions and/or rules correlating parameters in the expected test data to aid in training the ML module 580 to determine or identify refrigerant leaks. That is, the ML module 580 may be developed using mathematical expressions and/or creating rules related to the expected test data that may be executed to more accurately determine or identify refrigerant leak conditions or patterns indicative thereof within the test data during training of the ML module 580.

In some instances, the ML Module 580 can include, for example and without limitation, one or more language models, LLMs, attention-based neural networks, transformer-based neural networks, generative pretrained transformer (GPT) models, bidirectional encoder representations from transformers (BERT) models, encoder/decoder models, sequence to sequence models, autoencoder models, generative adversarial networks (GANs), convolutional neural networks (CNNs), recurrent neural networks (RNNs), diffusion models (e.g., denoising diffusion probabilistic models (DDPMs)), or various combinations thereof.

At step 630, the ML module 580 is trained to detect refrigerant leaks. For example, as test data is obtained from simulations with known refrigerant leak amounts, the ML module 580 can identify and store (e.g., within the memory 560) patterns of test data associated with the known refrigerant leak amounts to be compared to sensed data received from the sensors 510 during operation of an actual HVAC system (e.g., HVAC system 100) to identify potential refrigerant leaks. For example, in some embodiments, the ML module 580 may identify and store (e.g., within the memory 560) various parameter curves associated with differing levels of refrigerant leakage based on the inputted test data associated with those differing levels of refrigerant leakage. The ML module 580 may then use those curves to identify potential refrigerant leaks and corresponding amounts of refrigerant leakage of an actual HVAC system during operation by comparing the stored parameter curves (or individual parameters thereof) with parameters sensed during the operation of the actual HVAC system. That is, if a parameter curve associated with parameters sensed during operation of the actual HVAC system fits or otherwise corresponds to one or more of the various test data curves of the test data, the ML module 580 may identify or otherwise determine that there is a potential refrigerant leak with an estimated refrigerant leakage amount corresponding to the associated test data.

In some embodiments, only a part of the possible test data may be fed to the ML module 580 for training. In some embodiments, out of all the test data stored in the database 570, a predetermined amount of the total data is utilized for training the ML module 580. For example, in certain embodiments, only 80% of total test data is utilized to train the ML module 580.

At step 640, the ML module 580 is tested for detecting refrigerant leak. In some embodiments, remaining test data which was not fed to the ML module 580 during training can be utilized for testing the ML module 580. For example, when 80% of total test data is utilized for training of the ML module 580, as described above, the remaining 20% of the test data can be utilized for testing the ML module 580. In some embodiments, testing the ML module 580 includes inputting at least a part of the remaining test data to the ML module 580 to check whether the ML module 580 accurately determines the refrigerant leakage. That is, because the test data is a simulated data with known amounts of refrigerant leakage, output of the ML module 580 can be crosschecked against the true amount of refrigerant leakage corresponding to the test data input into the ML module 580 to verify the accuracy of the ML module 580.

At step 650, it is determined whether the ML module is correctly (e.g., accurately) determining or identifying refrigerant leaks. For example, when the output of the ML module 580 is crosschecked against the true amount of refrigerant leakage, the ML module 580 may be determined (e.g., by the processing circuit 540) to be correctly (e.g., accurately) determining or identifying refrigerant leaks if the ML module 580 is within a predetermined margin of error (e.g., within 5% of the true amount of refrigerant leakage).

If the processing circuit 540 determines that the ML module 580 is accurately determining refrigerant leaks and amounts of leakage, the processing circuit 540 may integrate, embed, or otherwise store the trained ML module 580 (e.g., in the memory 560 of the controller 520), at step 660. Alternatively, if the processing circuit 540 determines that the ML module 580 is not accurately determining refrigerant leaks and amounts of leakage, the processing circuit 540 may return to training the ML module 580, at step 630. This procedure is repeated by the processing circuit 540 until the ML module 580 accurately determines refrigerant leaks.

Figure 7:
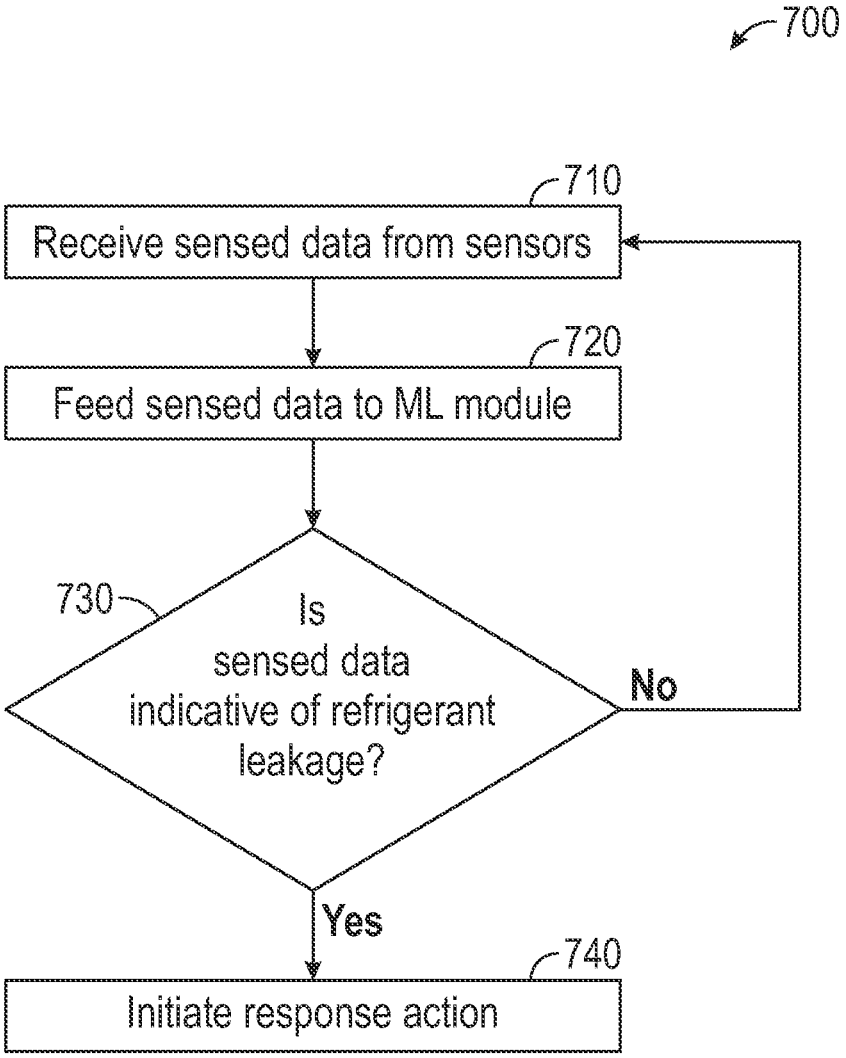
FIG. 7 is a flowchart depicting method steps for refrigerant leak detection, according to an exemplary embodiment.

Referring to FIG. 7, a method 700 of detecting a refrigerant leak is shown, according to an example embodiment. In some embodiments, the method 700 may represent an algorithm performed by the controller 520. For example, in some embodiments, the method 700 may be performed by the controller 520 to detect refrigerant leaks associated with the HVAC system 100. In other embodiments, the method 700 may be performed by other controllers or processing circuits generally to detect refrigerant leaks in other HVAC systems or other systems generally. It should be noted that, although the following description of the method 700 is described in a specific order, this order is not meant to be limiting. In some other embodiments, the method 700 may include additional or fewer steps performed in the same or in any other suitable order.

At step 710, the controller 520 receives sensed data from the sensors 510. In some instances, the sensed data may be stored in the database 570 and the controller 520 may condition sensed data before storing the same in the database 570. For example, the controller 520 may convert signals received from the sensors 510 into digital values and may store the digital values in the database 570 with a timestamp.

At step 720, the controller 520 feeds the sensed data as an input into the ML module 580. Accordingly, the ML module 580 receives the sensed data and performs various operations on the sensed data based on the configuration and algorithm provided in the ML module 580 (e.g., created during the building and training steps discussed above) to identify whether the system has a refrigerant leak based on the sensed data.

At step 730, the ML module 580 determines whether the sensed data received from the sensors 510 is indicative of refrigerant leakage. If the ML module 580 determines that the sensed data is not indicative of refrigerant leakage, the controller 520 continues to receive sensed data from the sensors 510, at step 710, and feed the sensed data to the ML module 580 at step 720.

However, if the ML module 580 determines that the sensed data is indicative of refrigerant leakage, the controller 520 determines that refrigerant is leaking/leaked through the HVAC system in which the system 500 is deployed (e.g., the HVAC system 100) and initiates one or more response actions, at step 740. For example, in some embodiments, the controller 520 may transmit an alarm upon determination of refrigerant leakage. The alarm may be in the form of a notification, a visual alarm, an audio alarm, or any combination thereof. In some embodiments, the controller 520 may transmit alarm signals on the user interface 530. The user interface 530 can be a part of the HVAC system in which the system 500 is deployed (e.g., the HVAC system 100) or can be an independent user interface provided with users.

In some embodiments, the response actions may include the controller 520 modifying operation of the HVAC system and/or various other systems upon detection of the refrigerant leakage. For example, modifying operation of the HVAC system may include generation of the alarm (e.g., if the alarm is part of the HVAC system itself). Further, the controller 520 may operate a ventilation system that is a part of, associated with, or near the HVAC system to blow off air contaminated with refrigerant. The controller 520 may actuate blowers of the ventilation system for removing refrigerant-contaminated air. In some embodiments, the controller 520 may shut down the HVAC system to prevent further leakage of the refrigerant. For example, the controller 520 may generate a control signal to shut down a compressor of the HVAC system. Referring to FIG. 5, in some embodiments, the system 500 includes one or more actuators 590 in communication with the controller 520 for modifying operation of the HVAC system. The actuators 590 can be in wired or wireless communication with the controller 520. For example, the actuators 590 may include a fan/blower actuator, a compressor actuator etc.

In some embodiments, the controller 520 may determine refrigerant leakage based on sensed data received from a refrigerant detecting sensor configured to detect the presence of leaked refrigerant within spaces or areas outside of the intended refrigerant circuit. In some embodiments, the controller 520 may determine refrigerant leakage based on sensed data received from the refrigerant detecting sensor as well as other sensed data of other parameters using machine learning techniques (e.g., the ML module 580). In some other embodiments, the controller 520 may determine refrigerant leakage based on sensed data of parameters such as temperature and/or pressure of at least one of refrigerant, supply air, and return air using machine learning techniques (e.g., the ML module 580).

The leak detection system described herein operates independent of type of refrigerant being used in an HVAC system. Further, as discussed above, the leak detection system described herein to automatically perform a variety of response actions upon determine that a refrigerant leak is occurring (e.g., generate alarms, operate components of an HVAC system) to mitigate refrigerant leakage.

In some embodiments, the leak detection systems and methods described above (e.g., the control 520 or a similar controller having a similarly trained ML module) may be implemented or otherwise integrated into an HVAC system that is part of a building data platform for a variety of purposes and to enable a variety of additional leak detection response functionality. An example building data platform within which the leak detection systems and methods described herein can be implemented is provided below. It should be appreciated that the leak detection systems and methods described herein can similarly be implemented in a variety of other building data platforms or systems generally, as desired for a given application.

Figure 8:
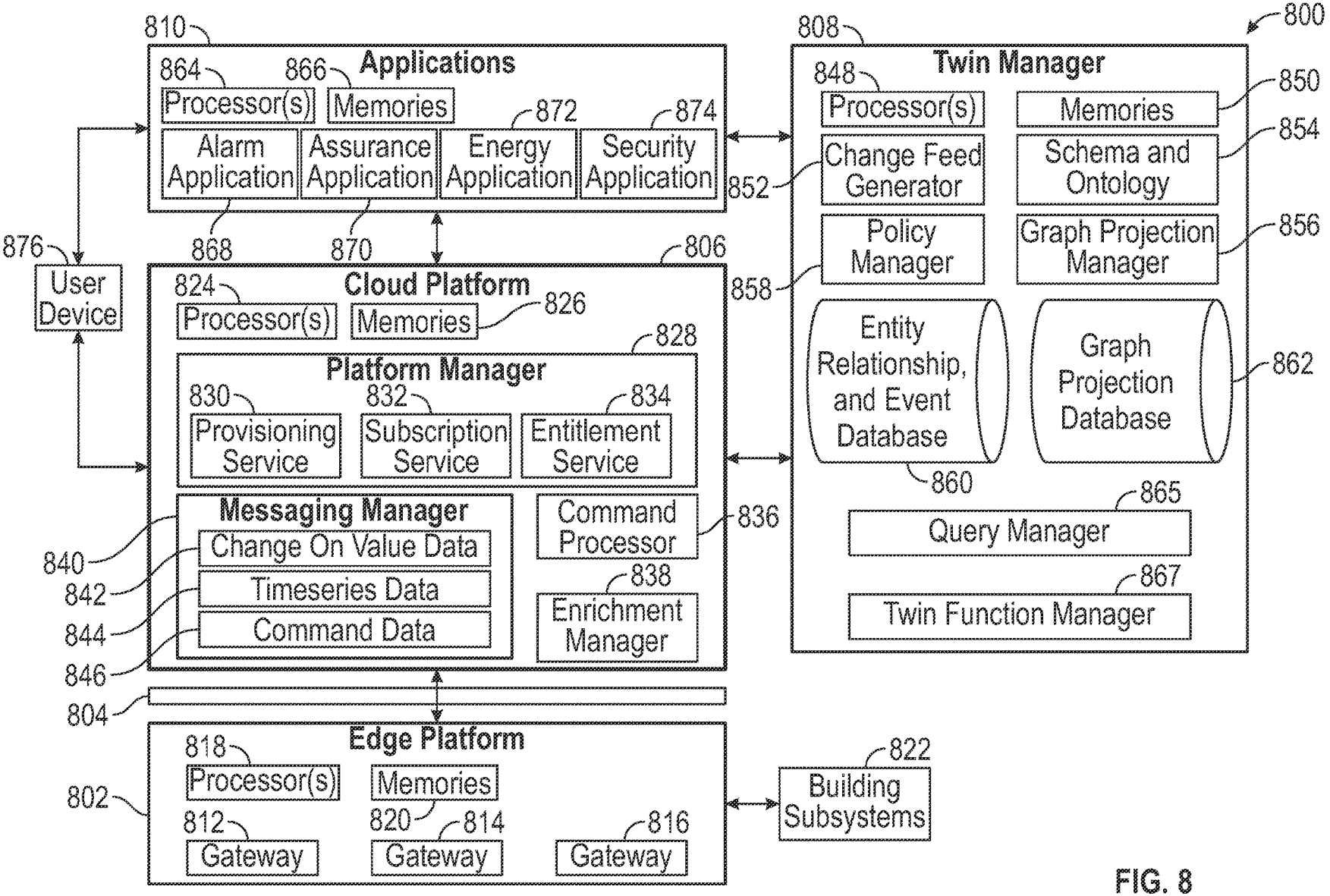
FIG. 8 is a block diagram of a building data platform including an edge platform, a cloud platform, and a twin manager, according to an exemplary embodiment.

Referring now to FIG. 8, a building data platform 800 including an edge platform 802, a cloud platform 806, and a twin manager 808 are shown, according to an exemplary embodiment. The edge platform 802, the cloud platform 806, and the twin manager 808 can each be separate services deployed on the same or different computing systems. In some embodiments, the cloud platform 806 and the twin manager 808 are implemented in off premises computing systems, e.g., outside a building. The edge platform 802 can be implemented on-premises, e.g., within the building. However, any combination of on-premises and off-premises components of the building data platform 800 can be implemented.

The building data platform 800 includes applications 810. The applications 810 can be various applications that operate to manage the building subsystems 822. The applications 810 can be remote or on-premises applications (or a hybrid of both) that run on various computing systems. The applications 810 can include an alarm application 868 configured to manage alarms for the building subsystems 822. The applications 810 include an assurance application 870 that implements assurance services for the building subsystems 822. In some embodiments, the applications 810 include an energy application 872 configured to manage the energy usage of the building subsystems 822. The applications 810 include a security application 874 configured to manage security systems of the building.

In some embodiments, the applications 810 and/or the cloud platform 806 interacts with a user device 876. In some embodiments, a component or an entire application of the applications 810 runs on the user device 876. The user device 876 may be a laptop computer, a desktop computer, a smartphone, a tablet, and/or any other device with an input interface (e.g., touch screen, mouse, keyboard, etc.) and an output interface (e.g., a speaker, a display, etc.).

The applications 810, the twin manager 808, the cloud platform 806, and the edge platform 802 can be implemented on one or more computing systems, e.g., on processors and/or memory devices. For example, the edge platform 802 includes processor(s) 818 and memories 820, the cloud platform 806 includes processor(s) 824 and memories 826, the applications 810 include processor(s) 864 and memories 866, and the twin manager 808 includes processor(s) 848 and memories 850. In some embodiments, one or more of the processors 818, 848, 864 and/or memories 826, 850, 866 may implement some or all of the functionality of the controller 520 discussed above to allow for the detection of refrigerant leakage associated with an HVAC system (e.g., one of the building subsystems 122) within the building associated with the building data platform 800, in accordance with the methods described herein.

The processors can be general purpose or specific purpose processors, an application specific integrated circuit (ASIC), one or more field programmable gate arrays (FPGAs), a group of processing components, or other suitable processing components. The processors may be configured to execute computer code and/or instructions stored in the memories or received from other computer readable media (e.g., CDROM, network storage, a remote server, etc.).

The memories can include one or more devices (e.g., memory units, memory devices, storage devices, etc.) for storing data and/or computer code for completing and/or facilitating the various processes described in the present disclosure. The memories can include random access memory (RAM), read-only memory (ROM), hard drive storage, temporary storage, non-volatile memory, flash memory, optical memory, or any other suitable memory for storing software objects and/or computer instructions. The memories can include database components, object code components, script components, or any other type of information structure for supporting the various activities and information structures described in the present disclosure. The memories can be communicably connected to the processors and can include computer code for executing (e.g., by the processors) one or more processes described herein.

The edge platform 802 can be configured to provide connection to the building subsystems 822. The building subsystems 822 can include a variety of systems associated with and/or provided within the building associated with the building data platform 100. For example, in some instances, the building subsystems 822 may include a fire prevention subsystem, an HVAC subsystem (e.g., the HVAC subsystem 100), a security subsystem, etc. The edge platform 802 can receive messages from the building subsystems 822 and/or deliver messages to the building subsystems 822. The edge platform 802 includes one or multiple gateways, e.g., the gateways 812-816. The gateways 812-816 can act as a gateway between the cloud platform 806 and the building subsystems 822. The gateways 812-816 can be or function similar to the gateways described in U.S. patent application Ser. No. 17/127,303, filed Dec. 18, 2020, the entirety of which is incorporated by reference herein. In some embodiments, the applications 810 can be deployed on the edge platform 802. In this regard, lower latency in management of the building subsystems 822 can be realized.

The edge platform 802 can be connected to the cloud platform 806 via a network 804. The network 804 can communicatively couple the devices and systems of building data platform 800. In some embodiments, the network 804 is at least one of and/or a combination of a Wi-Fi network, a wired Ethernet network, a ZigBee network, a Bluetooth network, and/or any other wireless network. The network 804 may be a local area network or a wide area network (e.g., the Internet, a building WAN, etc.) and may use a variety of communications protocols (e.g., BACnet, IP, LON, etc.). The network 804 may include routers, modems, servers, cell towers, satellites, and/or network switches. The network 804 may be a combination of wired and wireless networks.

The cloud platform 806 can be configured to facilitate communication and routing of messages between the applications 810, the twin manager 808, the edge platform 802, and/or any other system. The cloud platform 806 can include a platform manager 828, a messaging manager 840, a command processor 836, and an enrichment manager 838. In some embodiments, the cloud platform 806 can facilitate messaging between the building data platform 800 via the network 804.

The messaging manager 840 can be configured to operate as a transport service that controls communication with the building subsystems 822 and/or any other system, e.g., managing commands to devices (C2D), commands to connectors (C2C) for external systems, commands from the device to the cloud (D2C), and/or notifications. The messaging manager 840 can receive different types of data from the applications 810, the twin manager 808, and/or the edge platform 802. The messaging manager 840 can receive change on value data 842, e.g., data that indicates that a value of a point has changed. The messaging manager 840 can receive time series data 844, e.g., a time correlated series of data entries each associated with a particular time stamp. Furthermore, the messaging manager 840 can receive command data 846. All of the messages handled by the cloud platform 806 can be handled as an event, e.g., the data 842-846 can each be packaged as an event with a data value occurring at a particular time (e.g., a temperature measurement made at a particular time).

The cloud platform 806 includes a command processor 836. The command processor 836 can be configured to receive commands to perform an action from the applications 810, the building subsystems 822, the user device 876, etc. The command processor 836 can manage the commands, determine whether the commanding system is authorized to perform the particular commands, and communicate the commands to the commanded system, e.g., the building subsystems 822 and/or the applications 810. The commands could be a command to change an operational setting that control environmental conditions of a building, a command to run analytics, etc.

The cloud platform 806 includes an enrichment manager 838. The enrichment manager 838 can be configured to enrich the events received by the messaging manager 840. The enrichment manager 838 can be configured to add contextual information to the events. The enrichment manager 838 can communicate with the twin manager 808 to retrieve the contextual information. In some embodiments, the contextual information is an indication of information related to the event. For example, if the event is a time series temperature measurement of a thermostat, contextual information such as the location of the thermostat (e.g., what room), the equipment controlled by the thermostat (e.g., what VAV), etc. can be added to the event. In this regard, when a consuming application, e.g., one of the applications 810 receives the event, the consuming application can operate based on the data of the event, the temperature measurement, and also the contextual information of the event.

The enrichment manager 838 can solve a problem that when a device produces a significant amount of information, the information may contain simple data without context. An example might include the data generated when a user scans a badge at a badge scanner of the building subsystems 822. This physical event can generate an output event including such information as "DeviceBadgeScannerID," "BadgeID," and/or "Date/Time." However, if a system sends this data to a consuming application, e.g., Consumer A and a Consumer B, each customer may need to call the building data platform knowledge service to query information with queries such as, "What space, build, floor is that badge scanner in?" or "What user is associated with that badge?"

By performing enrichment on the data feed, a system can be able to perform inferences on the data. A result of the enrichment may be transformation of the message "DeviceBadgeScannerId, BadgeId, Date/Time," to "Region, Building, Floor, Asset, DeviceId, BadgeId, UserName, EmployeeId, Date/Time Scanned." This can be a significant optimization, as a system can reduce the number of calls by 1/n, where n is the number of consumers of this data feed.

By using this enrichment, a system can also have the ability to filter out undesired events. If there are 100 building in a campus that receive 100,000 events per building each hour, but only 1 building is actually commissioned, only 1/10 of the events are enriched. By looking at what events are enriched and what events are not enriched, a system can do traffic shaping of forwarding of these events to reduce the cost of forwarding events that no consuming application wants or reads.

An example of an event received by the enrichment manager 838 may be:

```
{
"id": "someguid",
"eventType": "Device_Heartbeat",
"eventTime": "2018-01-27T00:00:00+00:00"
"eventValue": 1,
"deviceID": "someguid"
}
```

An example of an enriched event generated by the enrichment manager 838 may be:

```
{
"id": "someguid",
"eventType": "Device_Heartbeat",
"eventTime": "2018-01-27T00:00:00+00:00"
"eventValue": 1,
"deviceID": "someguid",
"buildingName": "Building-48",
"buildingID": "SomeGuid",
"panelID": "SomeGuid",
"panelName": "Building-48-Panel-13",
"cityID": 371,
"cityName": "Milwaukee",
"stateID": 48,
"stateName": "Wisconsin (WI)",
"countryID": 1,
"countryName": "United States"
}
```

By receiving enriched events, an application of the applications 810 can be able to populate and/or filter what events are associated with what areas. Furthermore, user interface generating applications can generate user interfaces that include the contextual information based on the enriched events.

The cloud platform 806 includes a platform manager 828. The platform manager 828 can be configured to manage the users and/or subscriptions of the cloud platform 806. For example, what subscribing building, user, and/or tenant utilizes the cloud platform 806. The platform manager 828 includes a provisioning service 830 configured to provision the cloud platform 806, the edge platform 802, and the twin manager 808. The platform manager 828 includes a subscription service 832 configured to manage a subscription of the building, user, and/or tenant while the entitlement service 834 can track entitlements of the buildings, users, and/or tenants.

The twin manager 808 can be configured to manage and maintain a digital twin. The digital twin can be a digital representation of the physical environment, e.g., a building. The twin manager 808 can include a change feed generator 852, a schema and ontology 854, a graph projection manager 856, a policy manager 858, an entity, relationship, and event database 860, and a graph projection database 862.

The graph projection manager 856 can be configured to construct graph projections and store the graph projections in the graph projection database 862. For example, the graph projections can be similar to or the same as those described in U.S. patent application Ser. No. 17/834,768, filed Jun. 7, 2022, the entirety of which is incorporated by reference herein. Entities, relationships, and events can be stored in the database 860. The graph projection manager 856 can retrieve entities, relationships, and/or events from the database 860 and construct a graph projection based on the retrieved entities, relationships and/or events. In some embodiments, the database 860 includes an entity-relationship collection for multiple subscriptions.

In some embodiment, the graph projection manager 856 generates a graph projection for a particular user, application, subscription, and/or system. In this regard, the graph projection can be generated based on policies for the particular user, application, and/or system in addition to an ontology specific for that user, application, and/or system. In this regard, an entity could request a graph projection and the graph projection manager 856 can be configured to generate the graph projection for the entity based on policies and an ontology specific to the entity. The policies can indicate what entities, relationships, and/or events the entity has access to. The ontology can indicate what types of relationships between entities the requesting entity expects to see, e.g., floors within a building, devices within a floor, etc. Another requesting entity may have an ontology to see devices within a building and applications for the devices within the graph.

The graph projections generated by the graph projection manager 856 and stored in the graph projection database 862 can be a knowledge graph and is an integration point. For example, the graph projections can represent floor plans and systems associated with each floor. Furthermore, the graph projections can include events, e.g., telemetry data of the building subsystems 822. For example, in some instances, the telemetry data can include any of the sensor data described above (e.g., received from the sensors 510 or similar sensors of an HVAC system). The graph projections can show application services as nodes and API calls between the services as edges in the graph. The graph projections can illustrate the capabilities of spaces, users, and/or devices. The graph projections can include indications of the building subsystems 822, e.g., thermostats, cameras, VAVs, etc. The graph projection database 862 can store graph projections that keep up a current state of a building.

The graph projections of the graph projection database 862 can be digital twins of a building. Digital twins can be digital replicas of physical entities (e.g., locations, spaces, equipment, assets, etc.) that enable an in-depth analysis of data of the physical entities and provide the potential to monitor systems to mitigate risks, manage issues, and utilize simulations to test future solutions. For example, in some embodiments, an HVAC system can be replicated and monitored within the context of a digital twin to detect refrigerant leaks in accordance with the systems and methods described herein (e.g., with reference to FIGS. 5-7). Digital twins can play an important role in helping technicians find the root cause of issues and solve problems faster, in supporting safety and security protocols, and in supporting building managers in more efficient use of energy and other facilities resources. Digital twins can be used to enable and unify security systems, employee experience, facilities management, sustainability, etc.

In some embodiments the enrichment manager 838 can use a graph projection of the graph projection database 862 to enrich events. In some embodiments, the enrichment manager 838 can identify nodes and relationships that are associated with, and are pertinent to, the device that generated the event. For example, the enrichment manager 838 could identify a thermostat generating a temperature measurement event within the graph. The enrichment manager 838 can identify relationships between the thermostat and spaces, e.g., a zone that the thermostat is located in. The enrichment manager 838 can add an indication of the zone to the event.

Furthermore, the command processor 836 can be configured to utilize the graph projections to command the building subsystems 822. For example, in some embodiments, upon detecting a refrigerant leak, as discussed above, the command processor 836 can command one or more building subsystems 822 to perform one or more of the various response actions described above, with respect to FIG. 7. The command processor 836 can identify a policy for a commanding entity within the graph projection to determine whether the commanding entity has the ability to make the command. For example, the command processor 836, before allowing a user to make a command, may determine, based on the graph projection database 862, that the user has a policy to be able to make the command.

In some embodiments, the policies can be conditional based policies. For example, the building data platform 800 can apply one or more conditional rules to determine whether a particular system has the ability to perform an action. In some embodiments, the rules analyze a behavioral based biometric. For example, a behavioral based biometric can indicate normal behavior and/or normal behavior rules for a system. In some embodiments, when the building data platform 800 determines, based on the one or more conditional rules, that an action requested by a system does not match a normal behavior, the building data platform 800 can deny the system the ability to perform the action and/or request approval from a higher-level system.

For example, a behavior rule could indicate that a user has access to log into a system with a particular IP address between 8 A.M. through 5 P.M. However, if the user logs in to the system at 7 P.M., the building data platform 800 may contact an administrator to determine whether to give the user permission to log in.

The change feed generator 852 can be configured to generate a feed of events that indicate changes to the digital twin, e.g., to the graph. The change feed generator 852 can track changes to the entities, relationships, and/or events of the graph. For example, the change feed generator 852 can detect an addition, deletion, and/or modification of a node or edge of the graph, e.g., changing the entities, relationships, and/or events within the database 860. In response to detecting a change to the graph, the change feed generator 852 can generate an event summarizing the change. The event can indicate what nodes and/or edges have changed and how the nodes and edges have changed. The events can be posted to a topic by the change feed generator 852.

The change feed generator 852 can implement a change feed of a knowledge graph. The building data platform 800 can implement a subscription to changes in the knowledge graph. When the change feed generator 852 posts events in the change feed, subscribing systems or applications can receive the change feed event. By generating a record of all changes that have happened, a system can stage data in different ways, and then replay the data back in whatever order the system wishes. This can include running the changes sequentially one by one and/or by jumping from one major change to the next. For example, to generate a graph at a particular time, all change feed events up to the particular time can be used to construct the graph.

The change feed can track the changes in each node in the graph and the relationships related to them, in some embodiments. If a user wants to subscribe to these changes and the user has proper access, the user can simply submit a web API call to have sequential notifications of each change that happens in the graph. A user and/or system can replay the changes one by one to reinstitute the graph at any given time slice. Even though the messages are "thin" and only include notification of change and the reference "id/seq id," the change feed can keep a copy of every state of each node and/or relationship so that a user and/or system can retrieve those past states at any time for each node. Furthermore, a consumer of the change feed could also create dynamic "views" allowing different "snapshots" in time of what the graph looks like from a particular context. While the twin manager 808 may contain the history and the current state of the graph based upon schema evaluation, a consumer can retain a copy of that data, and thereby create dynamic views using the change feed.

The schema and ontology 854 can define the message schema and graph ontology of the twin manager 808. The message schema can define what format messages received by the messaging manager 840 should have, e.g., what parameters, what formats, etc. The ontology can define graph projections, e.g., the ontology that a user wishes to view. For example, various systems, applications, and/or users can be associated with a graph ontology. Accordingly, when the graph projection manager 856 generates a graph projection for a user, system, or subscription, the graph projection manager 856 can generate a graph projection according to the ontology specific to the user. For example, the ontology can define what types of entities are related in what order in a graph, for example, for the ontology for a subscription of "Customer A," the graph projection manager 856 can create relationships for a graph projection based on the rule:

Region ↔ Building ↔ Floor ↔ Space ↔ Asset

For the ontology of a subscription of "Customer B," the graph projection manager 856 can create relationships based on the rule:

Building ↔ Floor ↔ Asset

The policy manager 858 can be configured to respond to requests from other applications and/or systems for policies. The policy manager 858 can consult a graph projection to determine what permissions different applications, users, and/or devices have. The graph projection can indicate various permissions that different types of entities have and the policy manager 858 can search the graph projection to identify the permissions of a particular entity. The policy manager 858 can facilitate fine grain access control with user permissions. The policy manager 858 can apply permissions across a graph, e.g., if "user can view all data associated with floor 1" then they see all subsystem data for that floor, e.g., surveillance cameras, HVAC devices, fire detection and response devices, etc.

The twin manager 808 includes a query manager 865 and a twin function manager 867. The query manger 864 can be configured to handle queries received from a requesting system, e.g., the user device 876, the applications 810, and/or any other system. The query manager 865 can receive queries that include query parameters and context. The query manager 865 can query the graph projection database 862 with the query parameters to retrieve a result. The query manager 865 can then cause an event processor, e.g., a twin function, to operate based on the result and the context. In some embodiments, the query manager 865 can select the twin function based on the context and/or perform operations based on the context. In some embodiments, the query manager 865 is configured to perform a variety of differing operations. For example, in some instances, the query manager 865 is configured to perform any of the operations performed by the query manager described in U.S. patent application Ser. No. 17/537,046, filed Nov. 29, 2021, the entirety of which is incorporated by reference herein.

The twin function manager 867 can be configured to manage the execution of twin functions. The twin function manager 867 can receive an indication of a context query that identifies a particular data element and/or pattern in the graph projection database 862. Responsive to the particular data element and/or pattern occurring in the graph projection database 862 (e.g., based on a new data event added to the graph projection database 862 and/or change to nodes or edges of the graph projection database 862), the twin function manager 867 can cause a particular twin function to execute. The twin function can be executed based on an event, context, and/or rules. The event can be data that the twin function executes against. The context can be information that provides a contextual description of the data, e.g., what device the event is associated with, what control point should be updated based on the event, etc. The twin function manager 867 can be configured to perform a variety of differing operations. For example, in some instances, the twin function manager 867 is configured to perform any of the operations of the twin function manager described in U.S. patent application Ser. No. 17/537,046, referenced above.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied, and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general-purpose computer, special purpose computer, or special purpose processing machines to perform a certain function or group of functions.

Although the figures show a specific order of method steps, the order of the steps may differ from what is depicted. Also, two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps.

What is claimed is:

1. A system for refrigerant leak detection, the system comprising:

one or more sensors configured to detect one or more parameters of a heating, ventilation, and/or air conditioning (HVAC) system;

one or more storage devices storing instructions thereon that, when executed by one or more processors, cause the one or more processors to:

receive at least one of temperature sensor data, pressure sensor data, or gas sensor data from the one or more sensors;

apply the at least one of the temperature sensor data, the pressure sensor data, or the gas sensor data to one or more machine learning models, the one or more machine learning models trained to identify refrigerant leaks associated with HVAC systems;

determine, using the one or more machine learning models, that the at least one of the temperature sensor data, the pressure sensor data, or the gas sensor data is indicative of a refrigerant leak; and in response to determining that the at least one of the temperature sensor data, the pressure sensor data, or the gas sensor data is indicative of the refrigerant leak, initiate a response action.

2. The system of claim 1, wherein the response action is at least one of generating an alert indicative of the refrigerant leak, actuating one or more components of a ventilation unit, or shutting down the HVAC system.

3. The system of claim 1, wherein the one or more sensors include at least one of an evaporator coil temperature sensor, a return air temperature sensor, a return air pressure sensor, a supply air temperature sensor, or a supply air pressure sensor.

4. The system of claim 1, wherein the one or more sensors include one or more refrigerant detecting sensors.

5. The system of claim 1, wherein the instructions further cause the one or more processors to:

collect test data corresponding to one or more refrigerant leaks associated with HVAC systems; and train the one or more machine learning models to identify the refrigerant leaks associated with HVAC systems using the test data.

6. The system of claim 5, wherein the test data is generated using one or more simulated test setups configured to produce test conditions corresponding to different amounts of refrigerant leakage.

7. The system of claim 5, wherein the test data is collected periodically and the one or more machine learning models are continuously trained using the periodically collected test data.

8. A system for refrigerant leak detection, the system comprising:

one or more storage devices storing instructions thereon that, when executed by one or more processors, cause the one or more processors to:

collect test data corresponding to one or more refrigerant leaks associated with heating, ventilation, and/or air conditioning (HVAC) systems;

train one or more machine learning models to identify refrigerant leaks associated with HVAC systems using the test data;

receive at least one of temperature sensor data, pressure sensor data, or gas sensor data from one or more sensors associated with an HVAC system; and determine, using the one or more machine learning models, that the at least one of the temperature sensor data, the pressure sensor data, or the gas sensor data is indicative of a refrigerant leak.

9. The system of claim 8, wherein the test data is generated using one or more simulated test setups configured to produce test conditions corresponding to different amounts of refrigerant leakage.

10. The system of claim 8, wherein the test data is collected periodically and the one or more machine learning models are continuously trained using the periodically collected test data.

11. The system of claim 8, wherein the one or more sensors include at least one of an evaporator coil temperature sensor, a return air temperature sensor, a return air pressure sensor, a supply air temperature sensor, or a supply air pressure sensor.

12. The system of claim 8, wherein the one or more sensors include one or more refrigerant detecting sensors.

13. The system of claim 8, wherein the instructions further cause the one or more processors to, in response to determining that the sensor data is indicative of the refrigerant leak, initiate a response action.

14. The system of claim 13, wherein the response action is at least one of generating an alert indicative of the refrigerant leak, actuating one or more components of a ventilation unit, or shutting down the HVAC system.

15. A method for refrigerant leak detection, the method comprising:

receiving, by one or more processors of a system, at least one of temperature sensor data, pressure sensor data, or gas sensor data from one or more sensors associated with a heating, ventilation, and/or air conditioning (HVAC) system;

applying, by the one or more processors, the at least one of the temperature sensor data, the pressure sensor data, or the gas sensor data to one or more machine learning models, the one or more machine learning models trained to identify refrigerant leaks associated with HVAC systems;

determining, by the one or more processors using the one or more machine learning models, that the at least one of the temperature sensor data, the pressure sensor data, or the gas sensor data is indicative of a refrigerant leak; and in response to determining that the at least one of the temperature sensor data, the pressure sensor data, or the gas sensor data is indicative of the refrigerant leak, initiating, by the one or more processors, a response action.

16. The method of claim 15, wherein the response action is at least one of generating an alert indicative of the refrigerant leak, actuating one or more components of a ventilation unit, or shutting down the HVAC system.

17. The method of claim 15, wherein the one or more sensors include at least one of an evaporator coil temperature sensor, a return air temperature sensor, a return air pressure sensor, a supply air temperature sensor, or a supply air pressure sensor.

18. The method of claim 15, wherein the one or more sensors include one or more refrigerant detecting sensors.

19. The method of claim 15, further comprising:

collecting test data corresponding to one or more refrigerant leaks associated with HVAC systems; and train the one or more machine learning models to identify the refrigerant leaks associated with HVAC systems using the test data.

20. The method of claim 19, wherein the test data is collected periodically and the one or more machine learning models are continuously trained using the periodically collected test data.

* * * * *